US007464742B2

(12) United States Patent
Oskam et al.

(10) Patent No.: US 7,464,742 B2
(45) Date of Patent: Dec. 16, 2008

(54) RAISING AND LOWERING MECHANISM FOR BLINDS

(75) Inventors: Herman Oskam, Vlist (NL); Nicolaas Dekker, Barendrecht (NL); Jan Pieter Wetsema, Rotterdam (NL)

(73) Assignee: Hunter Douglas Industries BV, El Rotterdam (NL)

( * ) Notice: Subject to any disclaimer, the term of this patent is extended or adjusted under 35 U.S.C. 154(b) by 849 days.

(21) Appl. No.: 10/737,061

(22) Filed: Dec. 15, 2003

(65) Prior Publication Data

US 2004/0144501 A1 Jul. 29, 2004

(30) Foreign Application Priority Data

Dec. 18, 2002 (EP) ..... 02080464.7

(51) Int. Cl.
*E06B 9/30* (2006.01)

(52) U.S. Cl. ..... 160/170; 242/613.1

(58) Field of Classification Search ..... 160/170, 160/171, 168.1 R; 242/613.1
See application file for complete search history.

(56) References Cited

U.S. PATENT DOCUMENTS

| | | | | |
|---|---|---|---|---|
| 3,181,595 A | | 5/1965 | Pender | 160/171 |
| 3,856,229 A | * | 12/1974 | Byram | 242/587.2 |
| 4,574,597 A | * | 3/1986 | Buck et al. | 66/125 R |
| 5,802,880 A | * | 9/1998 | min | 66/132 R |
| 5,908,062 A | * | 6/1999 | Fun | 160/170 |
| 6,568,620 B1 | * | 5/2003 | Lampprecht et al. | 242/366 |
| 2001/0035269 A1 | * | 11/2001 | Judkins | 160/84.05 |
| 2003/0178155 A1 | * | 9/2003 | Fraczek | 160/170 |

FOREIGN PATENT DOCUMENTS

| | | |
|---|---|---|
| CH | 581 257 | 10/1976 |
| DE | 16269 | 2/1881 |
| EP | 0 554 212 | 8/1993 |
| GB | 986529 | 3/1965 |
| GB | 2 333 314 | 7/1999 |

* cited by examiner

*Primary Examiner*—Blair M. Johnson
(74) *Attorney, Agent, or Firm*—Dorsey & Whitney LLP

(57) ABSTRACT

A cord spool for winding a lift cord for lifting or lowering a window covering wherein the cord spool includes an elongated general cylindrical body with a large diameter end and a small diameter end and a circumferential outer surface of a given length extending therebetween. The circumferential outer surface having a plurality of generally parallely extending longitudinal ribs. The cord spool can be provided as part of a lifting and lowering mechanism for a blind further including a rotatable drive shaft and at least one lift cord. A support is provided for rotatably supporting the cord spool and the support may be attached to a head rail by means of a separate cord guiding grommet in the head rail. It may also include means for supporting a drive mechanism. The cord spool can be constructed from two halves and may also include an end plug, which can be snap-indexed between relative angular positions to adjust the cord length.

33 Claims, 12 Drawing Sheets

5
3
7
17
21
19
23
25
15
39
37
41
43
45
47
49
51
53
55
57
59
61
73
75
77
79
81
82
83
85
87
89
91
95
40

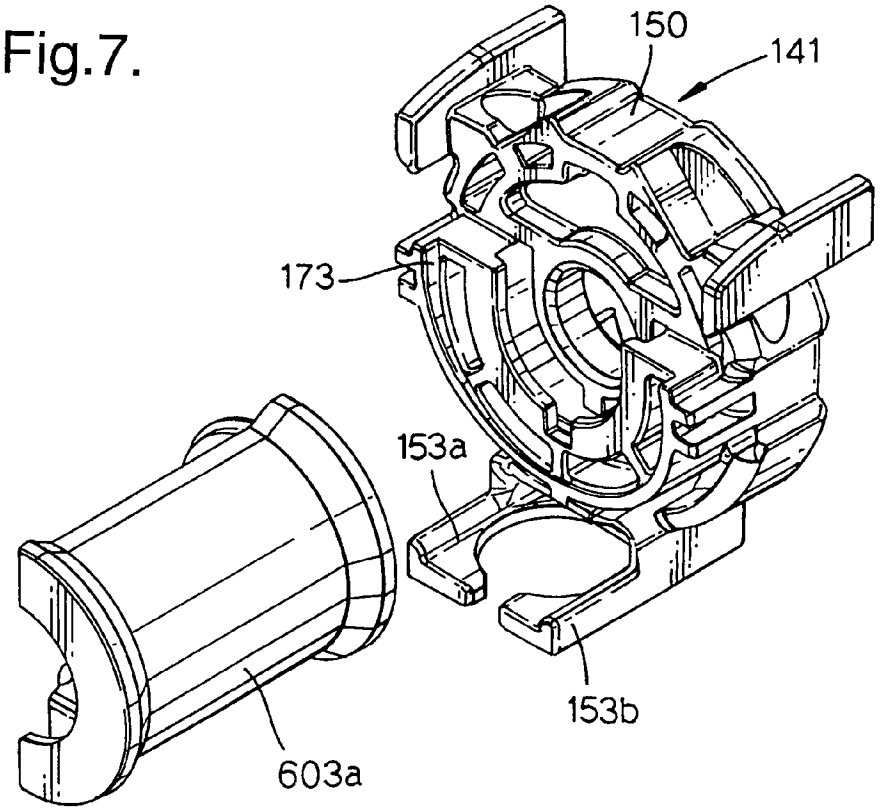
Fig.7.
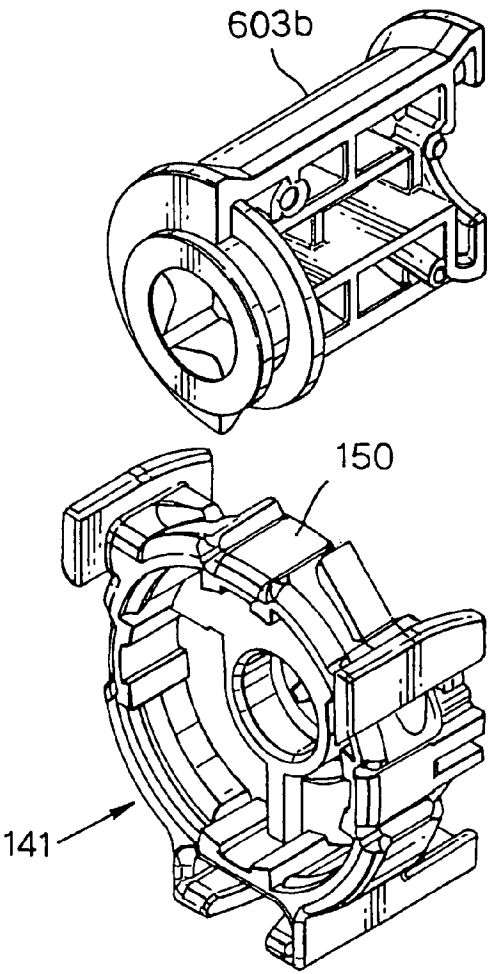

RAISING AND LOWERING MECHANISM FOR BLINDS

CROSS REFERENCE TO RELATED APPLICATIONS

This application claims priority to European patent application No. 02080464.7, filed 19 Dec. 2002, which is hereby incorporated by reference as if fully disclosed herein.

BACKGROUND OF THE INVENTION

1. Field of the Invention

The present invention relates to a raising and lowering mechanism for blinds, such as venetian blinds, roman shades, pleated blinds or the like. It includes a drive shaft and a driven cord spool mounted in keyed connection with the drive shaft, about which a lift cord can be wound in order to raise or lower the blind.

2. Description of the Relevant Art

Such devices are known and described in e.g. GB 986,529, U.S. Pat. No. 3,181,595 EP 0,554,212, CH 581,257, DE 16269 and GB 2,333,314.

A rotatably driven spool is used to wind or unwind the lift cords of a blind. The spool is usually mounted in a keyed connection to a driven shaft. The shaft can be driven by a pulley and chain or by a motor (not shown). In order to ensure even, regular windings of the lift cord, the spool can be provided with means to ensure that the spool is displaced longitudinally during rotation. Such a solution is described in GB 986,529, where the spool is provided with a screw thread, which is in driven connection to a screw thread of one of the journals in which the spool rests.

Other solutions are the use of a circumferentially threaded spool as described in U.S. Pat. No. 3,181,595. The cord winds in circumferential threads and the spool is transported by the threads in its longitudinal direction. The thread at the same time prevents overlapping windings. A drawback of such a spool was that different sizes of cords needed a differently configured spool thread. Also both these prior art solutions require relatively expensive machining of parts and are complicated in design and also require a lot of longitudinal space.

In order to solve the problem of transporting the windings in longitudinal direction without overlapping and without threading the spool, conical cord spools were proposed in a number of variations. These conical spools usually have a first end having a first diameter and a second end having a second diameter, the second diameter being smaller than the first. The spool includes a sloping portion where, the diameter of the spool reduces from the first diameter over a predetermined longitudinal length to the second smaller diameter. The cord is affixed to the small diameter end and is guided onto the spool at the large diameter end. Such spools are described in DE 16,269, CH 581, 257 and EP 0,554,212. The cord is wound around the spool starting at the first end of the spool with the larger diameter and is transported along the sloping part to the second end of the spool with the smaller diameter by each next winding. The decrease in diameter of the spool in the sloping portion ensures the transport of the windings and the even, regular winding of the cord. EP 0,554,212 additionally includes a circumferential flange or shoulder means at the larger diameter end of the spool to ensure transport of the windings in longitudinal direction towards the small diameter end of the spool. Also all the conical spools have a possibly smooth surface on the spool, to reduce friction and to facilitate the sliding of the windings in longitudinal direction towards the smaller end.

It has proven difficult to design a conical cord-winding spool, which ensures good winding under all circumstances. The problem of the longitudinal transport of the windings was largely solved by the conical shape, the shoulder means and by providing a smooth surface. Nevertheless an additional problem has sometimes manifested itself. By using a conical shape and a smooth surface to ensure the longitudinal transport of the windings, the friction of the cord in the circumferential direction also became very low and was no longer sufficient to reduce the tension of the cord over the windings. So although a low friction in longitudinal or axial direction is desired, a too high tension of the cord in the circumferential direction of the cord spool adversely affects the transport of the lift cord in axial direction of the spool.

It has now been found that the use of longitudinally extending ribs on the spool solves this problem.

SUMMARY OF THE INVENTION

In accordance with this invention, it has been proposed to provide a cord spool for winding a lift cord for lifting and lowering a window covering, the cord spool including an elongated generally cylindrical body with a first longitudinal spool end and a second longitudinal spool end and a circumferential outer surface, wherein the circumferential outer surface having a plurality of generally parallel extending longitudinally extending ribs.

In one embodiment the ribs extend along the total length of the spool from the first spool end to the second spool end.

In another embodiment a first number of long ribs extend along the total length of the spool, and a second number of short ribs extend along a first longitudinal portion of the spool and are shorter than the long ribs, the first longitudinal spool portion starting at the first spool end and extending a part of the total length of the spool towards the second spool end. The long and short ribs can be alternatingly place about the circumference of the first portion of the spool.

In yet another embodiment the ribs are tapered being wider at the first spool end and progressively narrowing towards the second.

It can be advantageous if the short ribs extending only along the first spool portion have a stronger taper than the long ribs extending along the total length of the spool.

The cord spool of all previous embodiments can also be a conical spool including a first spool diameter at first spool end and a second spool diameter at the second spool, the first spool diameter being larger than the second spool diameter, and the diameter of the spool decreasing over the total length of the spool from first spool end to second spool end.

Another feature of the spool can be that the cord spool also includes a second spool portion extending towards the second spool end after the first spool portion, and the first spool is conical with a stronger taper than the second spool portion.

Additionally the length of the second spool portion can be longer than the length of the first spool portion.

The cord spool of all previous embodiments can also include a mounting means for rotably mounting the cord spool in a support means, and wherein the support means includes a camming surface adjacent the first spool end for moving a first winding of the cord about the spool direction away from the first end of the cord spool, such that a next winding will not overlap the first winding.

The spool of all previous embodiments can also includes at least one longitudinally extending slot in the second spool end adapted to receive a second end of the lift cord for attachment to the spool.

The spool of most previous embodiments can also include an end plug attachable to the second spool end and adapted to receive a second end of the lift cord for attachment to the spool.

The end plug of the cord spool can include a longitudinally extending cylindrical portion forming an extension to the cord spool.

The cylindrical portion of the end plug can be a conical portion having an increasing diameter extending away from the second spool end.

The small diameter end and the end plug can include respective co-operating features which are able to secure resiliently the elongated generally cylindrical body and the end plug at a plurality of relative angular positions such that the end plug may be snap-indexed between the relative angular positions to adjust cord length.

Thus, the invention also pertains to a cord spool for winding a lift cord for lifting and lowering a window covering, the cord spool including an elongated generally cylindrical body with a first longitudinal spool end and a second longitudinal spool end and a circumferential outer surface and an end plug attachable to the second spool end and adapted to receive a second end of the lift cord for attachment to the spool wherein the second spool end and the end plug include respective co-operating features which are able to secure resiliently the elongated generally cylindrical body and the end plug in a plurality of relatively angular positions such that the end plug may be snap-indexed between the relatively angular positions to adjust cord length.

As will be described, one of the small diameter end and the end plug can be provided with one or more protrusions and the other of the small diameter end and end plug can be provided with a circumferential array of recesses, such that the protrusions can be indexed between the recesses so as to provide the required relative angular positions.

The invention has been described in relation to the cord spool having a first longitudinal spool end and a second longitudinal spool end. However, it should be appreciated that, in one design of spool, the second longitudinal spool end is positioned at an intermediate point along the length of the spool and two first longitudinal spools are provided at respective opposite ends of the overall cord spool. With this arrangement, a cord can be provided in a coiled arrangement around the spool, with the cord being unwound from one of the first longitudinal spool ends and the cord being wound onto the spool at the other first longitudinal spool end.

The cord spool can be embodied as two halves which are manufactured separately and then fixed together. The two halves are preferably identical in form and may be produced by (injection) moulding.

In order to allow the second longitudinal spool end or the central region between the two first longitudinal spool ends to have a level or cylindrical surface, the divide between the two halves of the cord spool is preferably formed along a plane containing the axis of the cord spool.

In accordance with the present invention, it is proposed to provide a cord spool for winding a lift cord for lifting and lowering a window covering, the cord spool including two halves arranged to be mounted together. Preferably, the two halves are identical. Preferably, the boundary between the two halves lies at least partly along a plane containing the axis of the spool.

The invention also pertains to a lifting and lowering mechanism for a blind, including:

a rotatable drive shaft;

at least one lift cord;

and a cord spool for winding the at least one lift cord and mounted for rotation with the winding shaft, the cord spool having a first diameter end and a second diameter end, defining a conical circumferential winding surface there between for the cord;

wherein the cord spool has a plurality of longitudinally extending, radial ribs on the winding surface, which are located at least on the circumferential area adjoining the first diameter end.

Additionally the lifting and lowering mechanism can further include an end plug attached to the second diameter end to receive one end of the at least one lift cord.

The end plug can have a cylindrical portion forming an extension to the spool, but being without a taper or with a taper opposite to the spool.

The end plug can include a plurality of circumferentially distributed radial slots, each of which is adapted to receive an end of the at least one lift cord for attachment.

The lifting and lowering mechanism of the previous embodiments can further including a support for rotatably supporting the cord spool.

The support can include a camming surface adjacent the first diameter end of the cord spool for guiding the lift cord to be wound onto the spool.

A first side of the support may be arranged to rotatably support the cord spool, whereas a second side, opposite the first side can be arranged to support a drive mechanism, such as a motor.

Preferably, the second side of the support is provided with features which allow the drive mechanism to be resiliently or snap-fitted to the support. The second side may be provided with one or more recesses, protrusions or resilient arms for connecting with corresponding features on the drive mechanism.

Hence, the lifting and lowering mechanism may additionally be provided with a drive mechanism, such as a motor, having corresponding respective features for connection with the features on the second side of the support.

The lifting and lowering mechanism can further include a grommet for insertion into a corresponding aperture in a head rail and for guiding the at least one lift cord to and from the cord spool. The support can be arranged to hold the grommet such that the support can be fixed to a head rail by means of the grommet.

The grommet can be formed from a wear resistant material different to the materials used for the support for the head rail.

The base of the support can be formed with an aperture in which the grommet fits.

The base of the support can be formed with two opposing arms which snap-fit around either side of the grommet.

The invention thus also pertains to a method of mounting in a head rail a support for rotatably supporting a cord spool, the method including;

providing, as a guide for a cord, a grommet in an aperture defined in the head rail;

providing the support with a base arranged to hold the grommet; and fitting the base of the support to the grommet mounted in the head rail.

The invention thus also pertains to a support for supporting a cord spool, the support being symmetric, such that it can be fitted on either side of a cord spool and can feed a cord to or from the cord spool in either rotational direction.

In this way, the support can be used with a cord spool on which a cord is wound or unwound or alternatively can be used at either end of a cord spool on which a cord is coiled simultaneously and wound and unwound from opposite respective ends.

Preferably, the first side of the support is arranged to rotatably support the cord spool and a second side, opposite the first side, is arranged to support a drive mechanism, such as a motor.

Preferably, the support has a base arranged to hold a grommet for guiding at least one lift cord to or from a cord spool.

The support may be provided in combination with such a grommet, the grommet being formed from a wear resistant material different from the material from which the support is constructed.

BRIEF DESCRIPTION OF THE DRAWINGS

FIGS. 7 to 9 illustrate a seventh embodiment of the cord spool having two halves, together with a support member of the invention.

DETAILED DESCRIPTION OF THE PREFERRED EMBODIMENTS

Further aspects of the invention will be apparent from the detailed description below.

Figure 1:
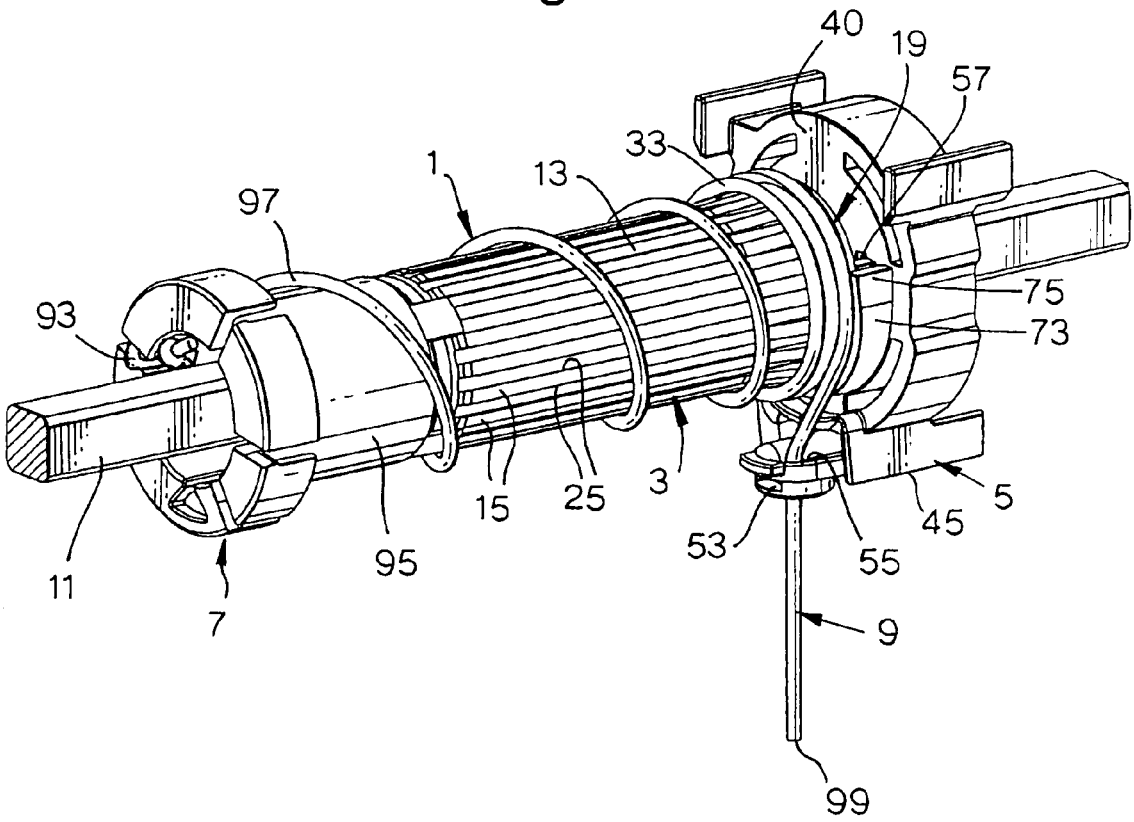
FIG. 1, is a front view of a first embodiment of the blind lifting and lowering device of the invention.
Figures 2, 2A:
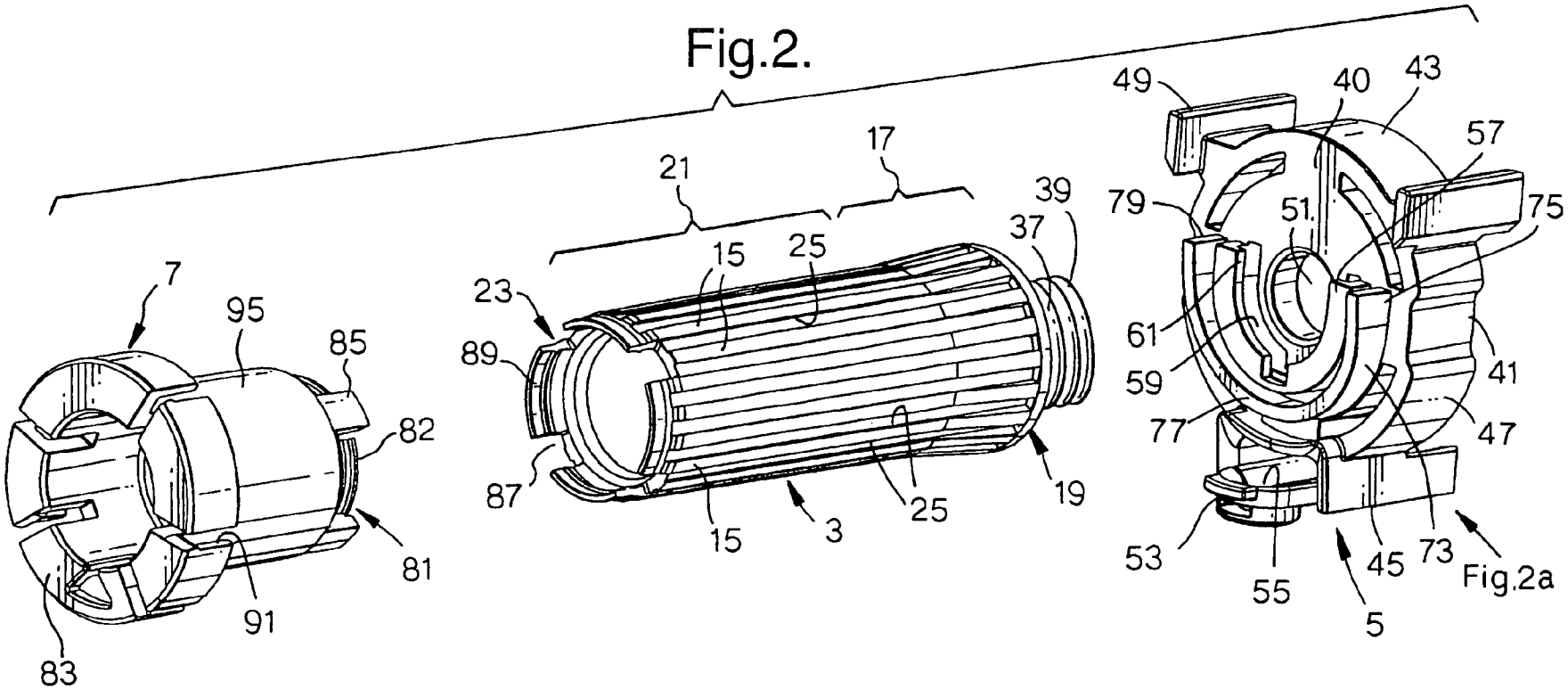
FIG. 2 is an exploded view of a first embodiment of the blind lifting and lowering device of the invention.
FIG. 2A is the partial view indicated as IIA in FIG. 2.
Figure 2A:
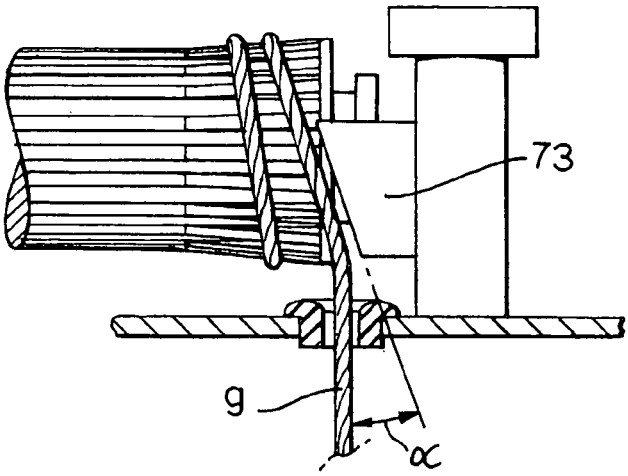

FIGS. 1 and 2 show a first embodiment of the blind lifting and lowering device 1 of the invention. The device includes a generally conical cord spool 3 rotatably mounted in a support member 5 and comprising an end plug 7. The support member can be mounted in a head rail of a blind (not shown). The cord spool 3 can be driven to rotate in clockwise and counterclockwise directions in order to wind or unwind a lift cord 9. The cord spool 3 can be driven by a conventional drive shaft 11.

As shown in FIG. 1, the spool has a circumferential outer surface 13 including longitudinally extending ribs 15. The ribs 15 are longitudinally extending and parallelly spaced on the outer circumference of the spool to define the outer surface 13 for receiving the lift cord 9. The ribs 15 are preferably of general rectangular shape.

As shown in FIG. 2, the ribs 15 are distributed evenly about the circumference of the spool 3. Also in the longitudinal direction a first sloping section 17 of the spool 3 adjacent a first, right or larger diameter end 19 has the same number of ribs as a second section 21 of the spool 3 adjacent the second, left or smaller diameter end 23 of the spool 3. The second spool section 21 can be level, but if the spool 3 is produced by (injection) molding, the second spool section 21 is preferably slightly sloped for reasons of moulding die design. The second spool section 21 is always more level than the first sloping section 17.

The ribs 15 provide for a relative narrow contacting surface for the lift cord windings, thus creating a reduced friction between the cord and spool in longitudinal direction of the spool and thereby facilitating the sliding movement of the cord windings towards the second smaller diameter end 23 of the spool. At the same time the longitudinal edges 25 of the individual ribs 15 provide for an enhanced friction between the cord and the spool in circumferential direction of the spool. This enhanced circumferential friction causes the cord tension in the windings of the cord to quickly reduce as the windings progress over the circumference of the spool and also creates a more evenly distributed cord tension in the initial windings 33.

The spool body 3 as shown in FIGS. 1 and 2 has a first, right, large diameter end 19, a first sloping portion 17, a level or very slightly sloping second portion 21 and a left, second, small diameter end 23 with a completely level or reversed sloping portion 95. The spool 3 is mounted in support member or carrier 5 at the large diameter end 19. The spool 3 has a relatively large diameter at the first diameter end 19 and a smaller diameter at the second end 23. The first sloping section 17 extends from the first end 19 in longitudinal direction of the spool to the second spool section 21. The beginning of the first spool section 17 coincides with the first spool end 19, the end of the first spool section 17 coincides with the beginning of the second spool section 21. The end of the second spool section 21 coincides with the second spool end 23 of the spool. The first spool section 17 is chosen to have a relatively steep slope and extends over a relatively short longitudinal portion of the spool 3. The first sloping section 17 is the section of the spool were the first cord windings 33 are formed and thus at that first section there is the largest risk of overlapping windings being created. The second spool section 21 of the spool 3 can extend over a longer portion of the spool than the first sloping section 17, and is of a lesser slope or level.

Extending longitudinally outward from the outer surface of the first end 19 of the spool 3 there is an annular mounting flange 37. A mounting ring 39 extends longitudinally and radially outward from the mounting flange 37. The mounting flange 37 and ring 39 are used to mount spool 3 on support member 5.

The support member 5 comprises a mounting side 40, a free side 41, a top 43, a bottom 45 and a front 47 and a rear side 49. A central opening 51 extends through the support member in longitudinal direction and rotatably accommodates the drive shaft 11. The support member 5 is a stationary part and is adapted to be mounted in a head rail of a window covering (not shown, but conventional). The bottom side 45 of the support member 5 comprises a horizontally extending base 53 and comprises a cord entrance opening 55 for guiding the lift cord 9 into the head rail (not shown) and towards the spool 3.

Extending longitudinally outwardly from the mounting side 40 of the support member 5 and co-extending with the spool is a cradle 57. When the spool 3 is mounted to the support member 5, the mounting ring 39 is rotatably carried by the cradle 57. Cradle 57 includes a semi-circular cradle base 59. Perpendicular to the cradle base 59 is radially inward extending cradle rim 61. An outer circumferential surface of mounting ring 39 rides rotatably on an inner semi-circular surface of cradle base 59 and the mounting ring 39 is axially retained by cradle rim 61.

As shown in FIG. 1 projecting from mounting side 40 of the support member 5 is a cord camming member 73. The cord camming member 73 is a semi-circular flange that projects longitudinally away from the mounting side 40 and is located radially outwardly away from the cradle base 59. The cord cam 73 extends longitudinally beyond the cradle base 59. The cord cam 73 has a front or start point 75, a middle bottom point 77 and a rear end point 79. The width of the cord cam is largest at its front and rear points 75,79 and smallest at the bottom point 77. The cam 73 thus has a pitch angle α relative to the lift cord 9 as it extends vertically down through cord entrance opening 55 of the support 5. The semi-circular shape of the cam 73 with the opposite start and end points 75,79 facilitates the right or left handed use of the support member 5. The cord 9 can be guided on the spool by the pitch α of cam 73 from front or rear sides 47,49 of the support 5, while the cord guiding opening 55 in support base 53 is centrally located between front and rear sides of the support member.

The cord cam 73 extends at its front and rear points 75,79 longitudinally co-axial with the cord spool 3, at the large diameter end 19 of the cord spool 3 where the cord spool diameter is at its maximum. This means that the diameter of the semi-circular cord cam 73 is larger than the maximum diameter of the cord spool. Thus allowing the spool to rotate free from the cord cam. At the same time the radial distance between the inner surface of cord cam 73 and the outer circumferential surface 13 of the spool 3, is substantially less than a single thickness of the lift cord 9. This prevents the lift cord 9 from moving between the cord cam and the spool surface.

The cam pitch angle α relative to the place of cord guiding opening 55 and to the cord spool 3 are such that the lift cord 9 is guided onto the spool as the spool rotates. The dimension from the lowest point of the cam to the highest should be about a single cord diameter.

In the case where the mounting ring has a diameter that is approximately the same as the diameter of the large diameter spool end, the cam and cradle of support member 5 can be integrally formed. Such a mounting ring 139 is shown in FIG. 3A.

The end plug 7 can be inserted into the small diameter end 23 of the cord spool 3 in any convenient manner. End plug 7 includes a plug-in end 81 and a free end 83. Such a plug 7 can have external projecting short fingers 85 and detent ridges 82 on the plug-in end 81 and can be used allowing the plug 7 to be inserted and fixed to the spool 3. The spool has cutouts 87 complementary to the fingers 85 and retaining ridge 89 complementary to the detent ridges 82 at the small diameter end 23 of spool 3 as shown in FIG. 2, ensuring engagement with the spool. The plug can be inserted in incremental angular positions of e.g. 90 degrees apart allowing for some length adjustment of the lift cord attached thereto. The free end 83 of the end plug is provided with radial slots 91. The lift cord 9 can be attached with the second cord end 93 to the end plug 7 by inserting it in one of the radial slots 91. The end plug 7 can have a longitudinal cylindrical portion 95 which can accommodate a number of windings 97 of the lift cord 9. No ribs are provided on the cylindrical portion 95 of the end plug 7. Ribs are only needed at the conical portion of the spool. There, tension of the cord is present and thus friction should be direction determined, which is what the ribs accomplish. Length of the end plug is a determined by a compromise between the space allowed in the head rail and height of the blind operated (i.e. the length of the cord to be wound).

In assembly the lift cord 9 with first cord end 99 is threaded upward through the headrail (not shown) and the cord guiding opening 55 in spool support 5 and attached with second cord end 93 to the cord spool 3. The downward extending first cord end 99 carries a window covering or a bottom rail thereof (not shown, but conventional). When the drive shaft 11 is driven to rotate the cord spool 3 (see FIG. 1), the lift cord 9 will be wound around the spool 3. Since the cord is attached to the bottom rail of the blind, the blind will be raised. When the cord is unwound the window covering is lowered. FIG. 1 shows a situation where the winding is only just started. As illustrated in FIG. 1 there are in total 4 complete windings 97 around the spool.

FIGS. 3A-D shows several possible configurations of the ribs and their distribution along the spool. For like parts like referral numbers are used greater by 100, 200, 300 and 400.

FIG. 3A shows a spool 103 including elongated ribs 115 extending from first, large diameter end 119 to second small diameter end 123. The long ribs 115 thus extend along a first sloping section of the spool 117 and also along a second spool section 121. This spool 103 of the second embodiment additionally includes a number of short ribs 116 that are placed between the long ribs 115 and only extend over a part of the total length of the spool body. As can be seen from the FIG. 3A the short ribs 116 extend only over the first section of the spool, the sloping section 117 where the cord windings are formed.

Figure 3D:
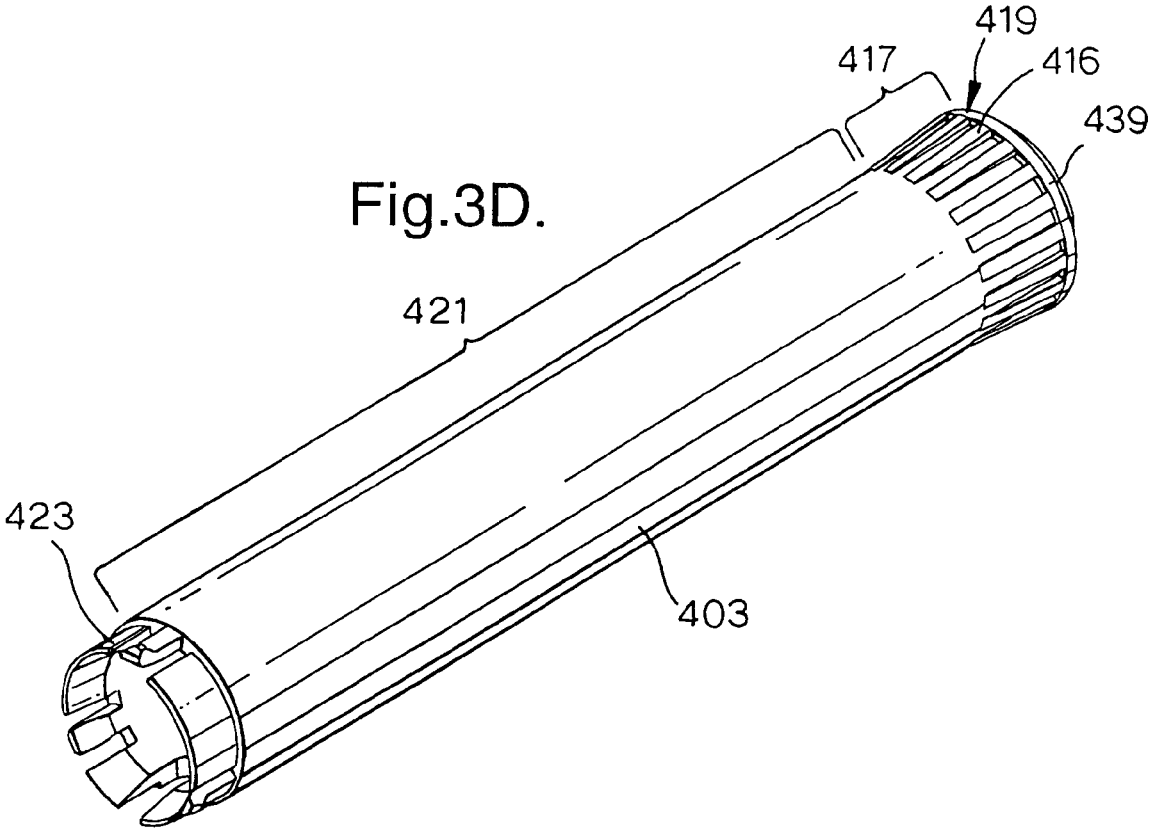
FIGS. 3A-D is a perspective view of second, third, fourth and fifth embodiments of the cord spool of the blind lifting and lowering device of the invention.
Figure 3A:
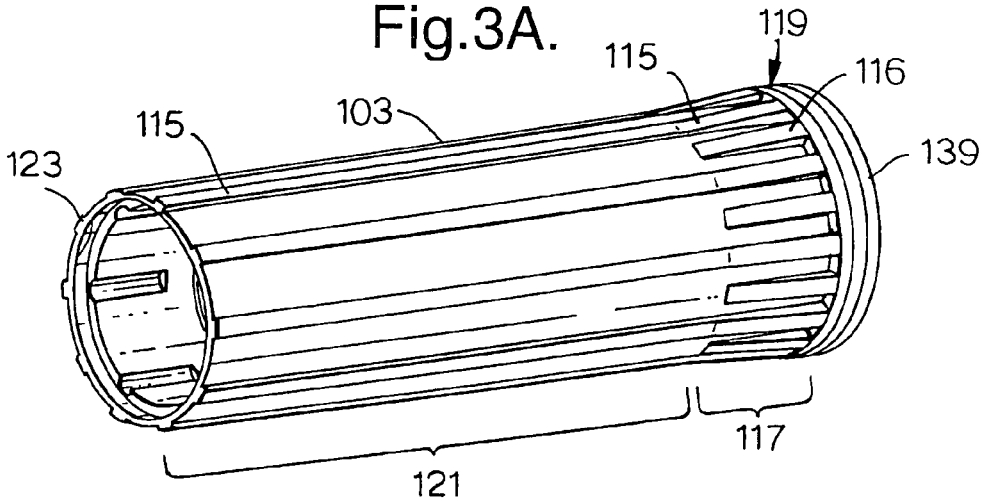
Figure 3B:
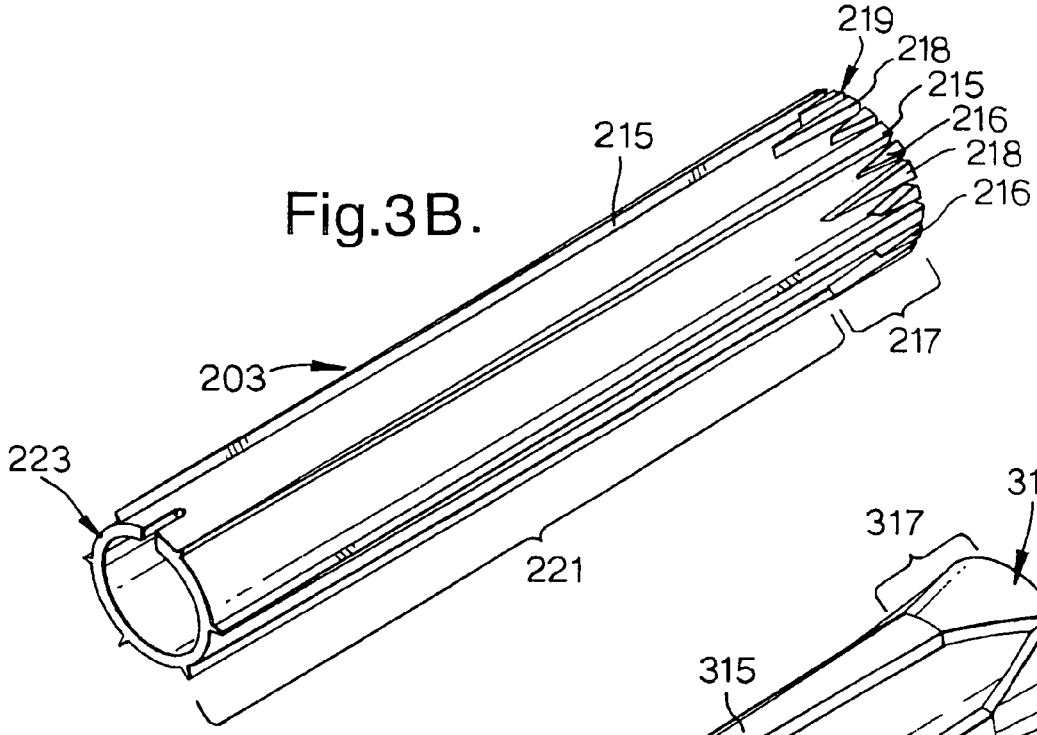

FIG. 3B shows a spool 203 of a third embodiment. This spool 203 includes a large diameter end 219, a first spool section 217, a second spool section 221, and a small diameter end 223. The spool 203 also includes long ribs 215 that extend along the whole length of the spool body 203. The long ribs 215 are tapered and are narrower at the second small diameter end 223 of the spool than they are at the larger diameter end 219 of the spool. Also at the large diameter end 219 of the spool 203 short and medium length ribs 216, 218 are positioned between the long ribs 215. The short ribs 216 are shorter in longitudinal direction than the medium ribs 218, which in turn are shorter than the full length ribs 215. All the ribs are tapered and are wider at the large diameter end 219 of the spool 203 and taper as they extend towards the small diameter end 223 of the spool 203. The large diameter end 219 can be almost the same diameter as the small diameter end 223, and the first and second spool sections 217, 221 can also have the same slope.

Figure 3C:
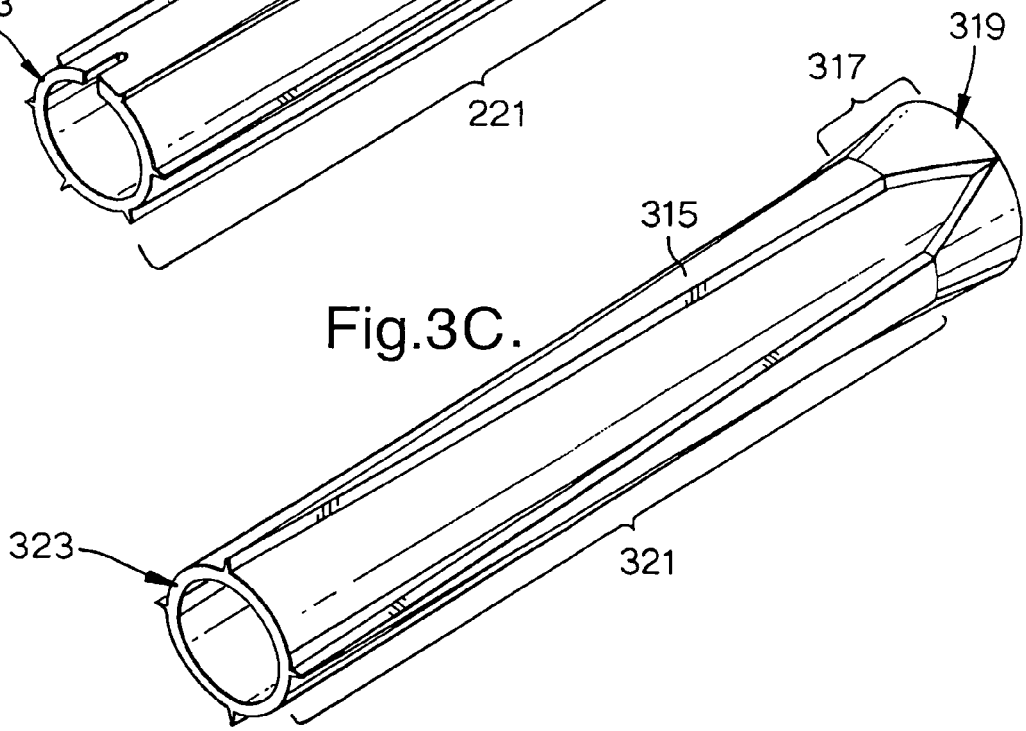

FIG. 3C shows a fourth embodiment of the spool 303. The ribs 315 are all tapered. The ribs 315 start very wide at the large diameter end 319 of the spool 303 where they are almost touching each other. But the taper is chosen such that the longitudinally extending rib edges 325 converge at an angle towards the smaller diameter end 323. The taper of the ribs 315 can be divided up into two zones, a sharp taper for the first section 317 of the spool 303 and a relatively flat taper at the second spool section 321 of the spool. Thus at the second spool section 321 of the spool 303 the ribs 315 seem to run almost parallel.

FIG. 3D shows a fifth embodiment of the spool 403. The ribs are all short ribs 416 that extend from the large diameter end 419 along the first sloping spool section 417 only. The second spool section 421 extending towards the small diameter end 423 is shaped like a cylinder without ribs.

The effect of the distribution of the ribs as shown in FIGS. 3A-3C is an alternative arrangement for ensuring enhanced sliding properties of the cord windings along a nearly level or level spool section 121, 221, 321 of the spool. Less ribs or narrower ribs due to tapering will cause less axial friction.

In a further embodiment the shape and dimensions of the ribs can be chosen such that they will approximate a circular section, and that the actual dimensions of the ribs are close to the cord diameter. This will keep the cord evenly tensioned, so the cord will not show bends, caused by heat influence after having been spooled-up for a longer period of time. Also it may assist to have the first cord winding in close contact with a camming surface, in order to prevent the windings from crossing each other. Variation in number of ribs, sizes etc will work as well. Spoke-like ribs are also possible.

The ribs 15, 115, 116, 215, 216, 218, 315, 416 of the spool 10 can be shaped by making grooves in the circumferential surface of spool 10. Or a ribbed spool can be conveniently injection molded from a suitable plastics material.

As shown in FIG. 3B the end plug can be omitted and one or more radial slots 291 can be made in small diameter end 223 of the spool 203, in which the second cord end (not shown) can be inserted.

Figure 4:
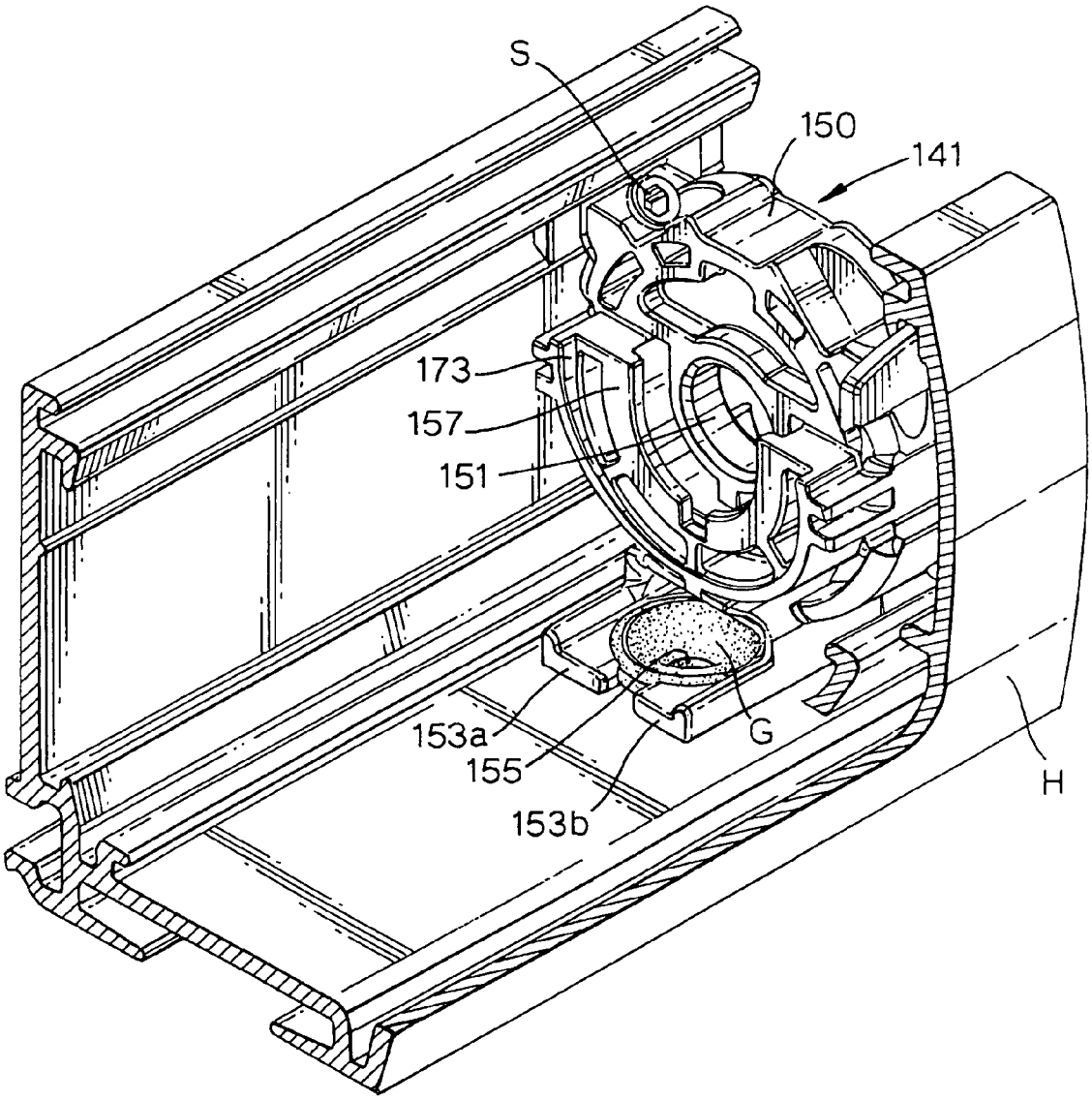
FIG. 4 illustrates a support member of the invention fitted to a head rail.

FIG. 4 illustrates a support member 150 fitted to a head rail H. As with the support member 5 of FIGS. 1 and 2, the support member 150 includes a central opening 151, a cradle 157 and a cord cam 173. Hence, the support member 150 supports a spool body in the same way as described previously.

The support member 150 includes a grub screw S which extends towards its outer periphery. The grub screw S may be used to exert pressure on the inner surface of the head rail H and, hence, frictionally secure the support member 150 in place.

In the embodiment of FIG. 4, the cord guiding opening 155 is provided in a separate member, namely a grommet G. The grommet G is held between opposing arms 153*a* and 153*b* of the support base 153. The support base 153 is thus forked and preferably snap-fits around the grommet G.

In a preferred embodiment, the grommet G is snap-fitted into an aperture in the bottom web of the head rail H. The arms 153*a*, 153*b* of the base 153 are then snap-fitted around the previously mounted grommet G, thereby locating the support member 150 in place. Optionally, one or more grub screws S may be tightened so as to further secure the support member 150 in place.

By providing the cord entrance opening 155 in a separate element, namely the grommet G, certain advantages may be achieved. In particular, the grommet G may be made of a wear resistant material different to that used for the construction of either the support member 150 or the head rail H. Wear resistant materials suitable for use as the cord entrance opening 155 may be unsuitable for use as the support member 150 or head rail H. Furthermore, such materials are often expensive. They could be introduced into a support member 150 or head rail H by insert moulding, but this again adds to the cost. With the arrangement of FIG. 4, the wear resistant material is used only where needed around the cord entrance opening 155, but the separate element, namely the grommet G, is used to provide an additional function of connecting the support member 150 to the head rail H.

Figure 5:
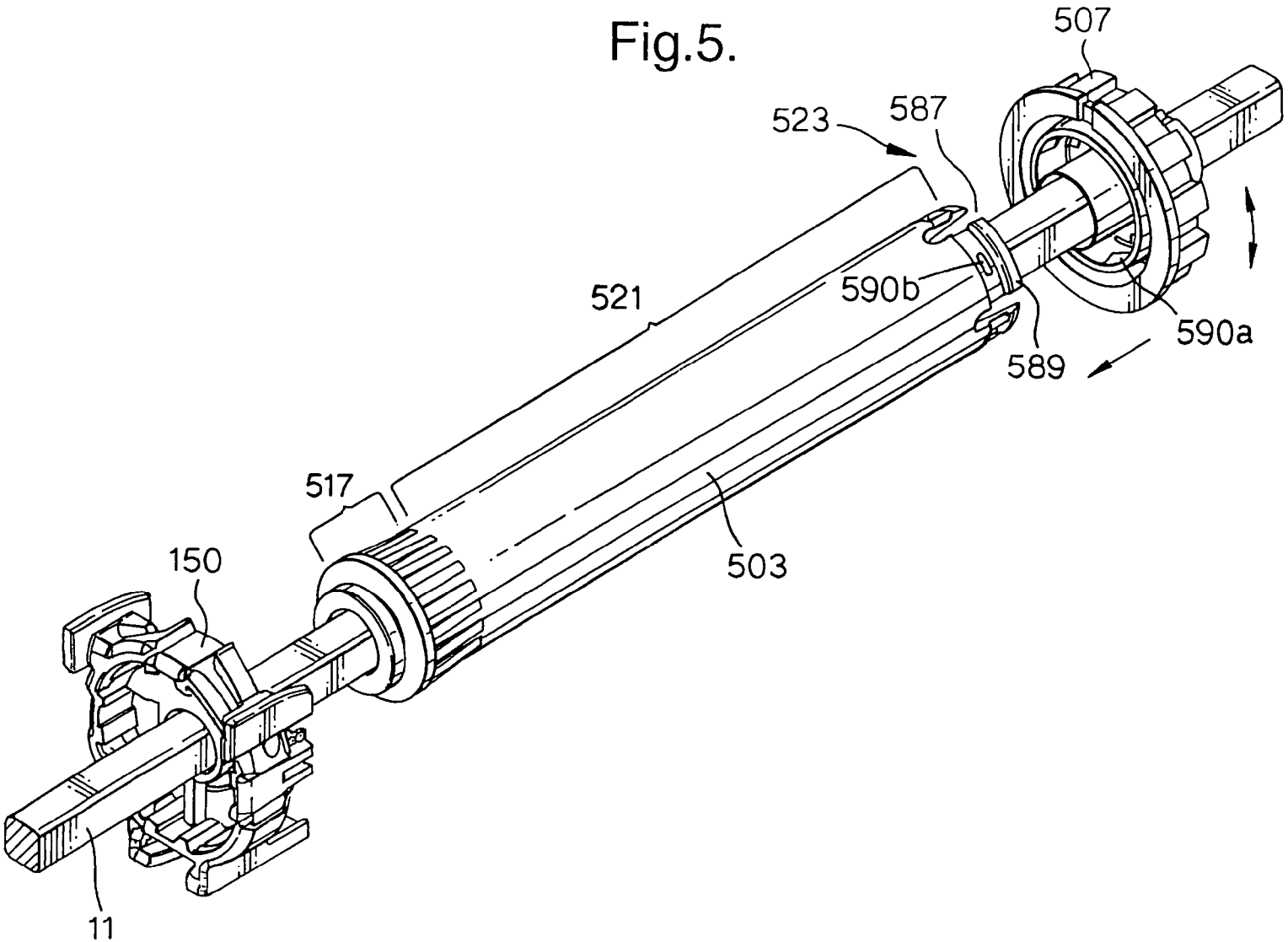
FIGS. 5 and 6 illustrate a sixth embodiment of the cord spool with a snap-indexed end plug and a support member of the invention.
Figure 6:
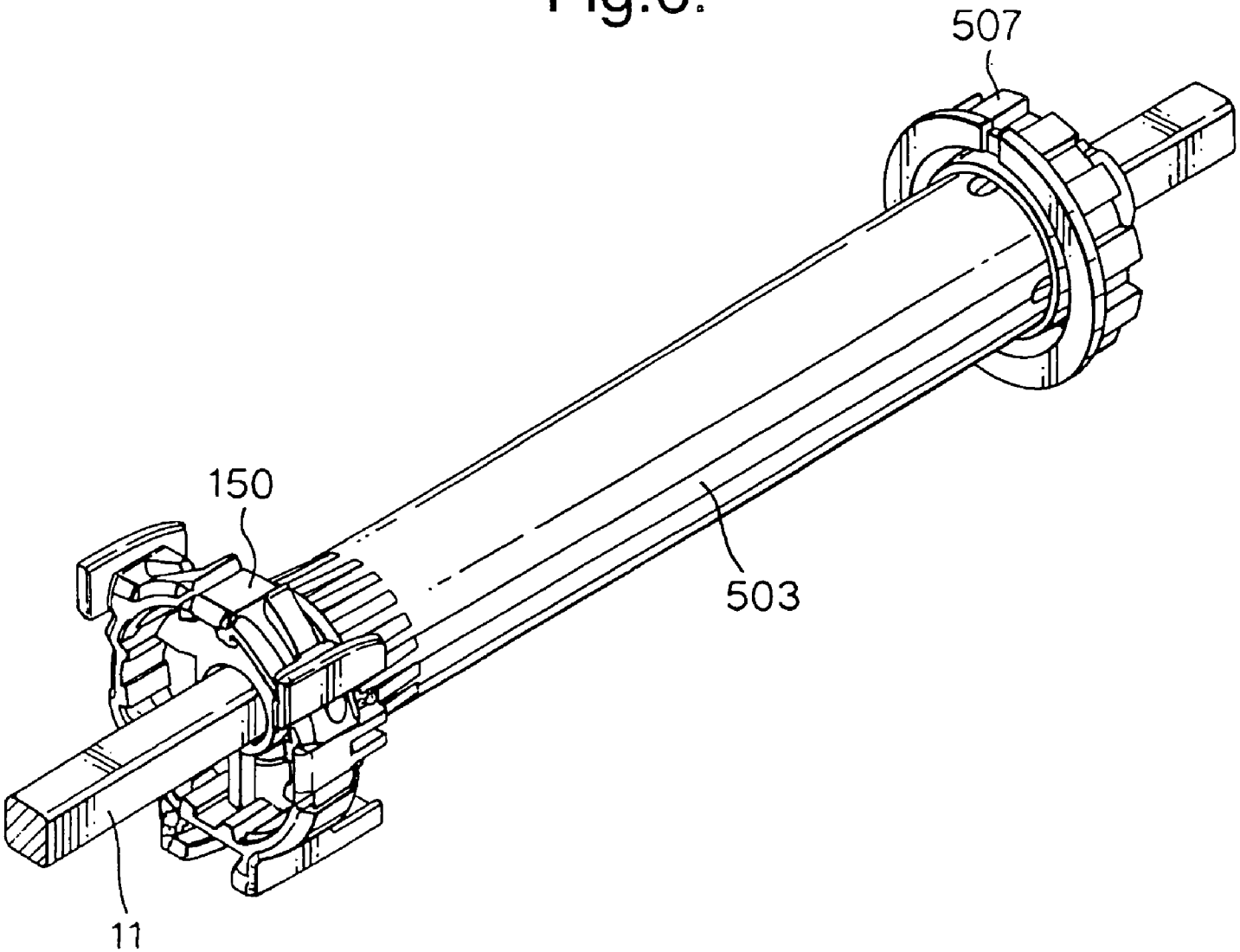

FIG. 5 illustrates the support member 150 in combination with a drive shaft 11, a cord spool 503 of a sixth embodiment and an end plug 507. FIG. 5 illustrates the components in an exploded arrangement and FIG. 6 illustrates them assembled.

The cord spool 503 of this embodiment is very similar to the cord spool 403 of the fifth embodiment, but includes a modified small diameter end 523.

A peripheral and radially extending retaining ridge 589 is provided at the axial end of the cord spool 503. This push fits into an inner portion of the end plug 507, such that the end plug 507 snap-fits onto the cord spool 503. In addition, extending radially inwardly is at least one protrusion 590*a*. On the small diameter end 523, behind the retaining ridge 589 is at least one recess 590*b* for receiving the protrusion 590*a*. By providing a plurality of protrusions 590*a* and/or a plurality of corresponding recesses 590*b*, it is possible to rotationally locate the end plug 507 on the cord spool 503 at a plurality of different angular positions. Indeed, preferably, the end plug 507 may be snap-fitted onto the cord spool 503 in an axial direction then rotated and indexed rotationally so as to adjust the required cord length. The cord preferably passes between the cord spool 503 and end plug 507 through at least one cut out 587. It may then be attached to the end plug 507 such that rotating the end plug 507 relative to the cord spool 503 will take up some of the length of the cord and provide some adjustment.

In a preferred embodiment, a plurality of protrusions 590*a* are provided facing radial inwardly of the end plug 507. If these are spaced relatively evenly around the circumference of end plug 507, they may be sufficient to interact with the retaining ridge 589 of the cord spool 503 and, hence, locate the end plug of 507 axially. In other word, it is not then necessary to provide a ridge or groove inside the end plug 507 for interaction with the retaining ridge 589 of the cord spool 503.

In another embodiment, it is not necessary to provide detent or recesses 590*b* in the small diameter end 523 of the cord spool 503. Instead, the protrusions 590*a* could be arranged to interact with the cut outs 587.

It will also be appreciated that, instead of protrusions 590*a* on the end plug 507 and recesses 590*b* in the cord spool 503, protrusions could be formed on the cord spool 503 with corresponding recesses in the end plug 507. Indeed, in one embodiment, the retaining ridge 589 could itself form the required protrusions and locate in a circumferential array of recesses within the end plug 507. The important feature is that the end plug 507 can attach to the cord spool 503 at a plurality of angular positions and can snap-index rotationally between those positions so as to provide adjustment of the cord length.

As mentioned above, the second spool section 21, 121, 221, 321, 421 and 521 can be level, but, if the spool in produced by (injection) moulding, the second spool section 21 is preferably slightly sloped for reasons of moulding die design. Certainly, it is not possible, using (injection) moulding, to provide an additional section at an end opposite the first section 17, 117, 217, 317, 417 and 517 which increases in diameter.

This might be of particular concern when manufacturing a spool for instance as proposed in GB 2,333,314. With this design of spool, the cord is not attached to the spool. The cord in coiled around the spool and unwinds from one end whilst being wound onto the other end. To maintain the cord on the spool, circumferential flanges are provided at both axial ends, such that it would not be possible to remove the spool axially from a moulding die.

To overcome this problem, the present application recognises for the first time the possibility of providing the spool as two halves. This is illustrated in FIG. 7 for a spool 603*a*, 603*b* of the type used for the arrangement of GB 2,333,314. In this respect, it will be appreciated that the spool 603 can be considered as two of the spools discussed for the embodiments above joined end to end. In this way, sloping sections could be provided at each end of the spool 603 and extend towards second spool sections forming the longitudinal centre of the spool. One or both of the first sloping sections can be provided with any of the groove arrangements described above and, similarly, the second spool sections meeting at the centre can also be provided with any of the surfaces described above.

Preferably, the two spool halves 603*a* and 603*b* are symmetric and identical such that a moulding die need only be produced for one component. By providing the division between the two halves 603*a* and 603*b* along a plane containing the axis of the spool, it is possible to provide at least the central section of the spool with a level or cylindrical outer surface.

Figure 8A:
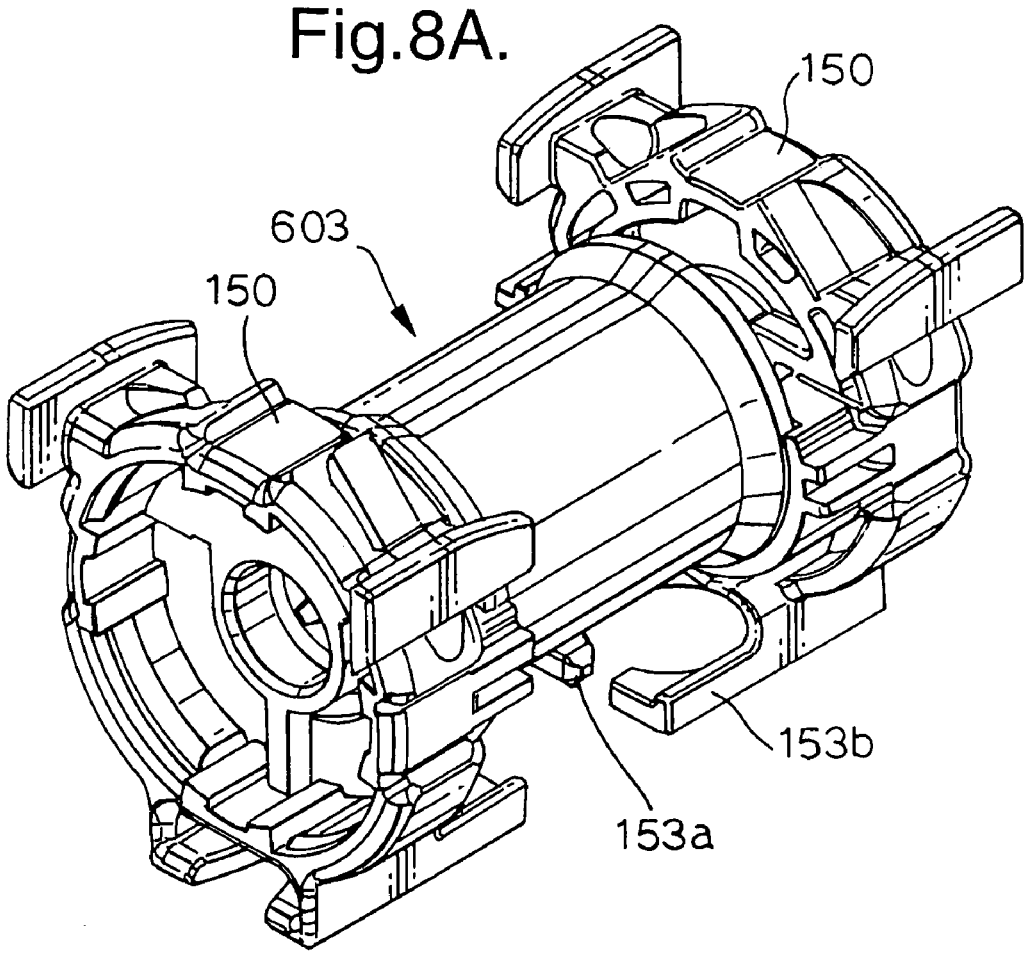
Figure 8B:
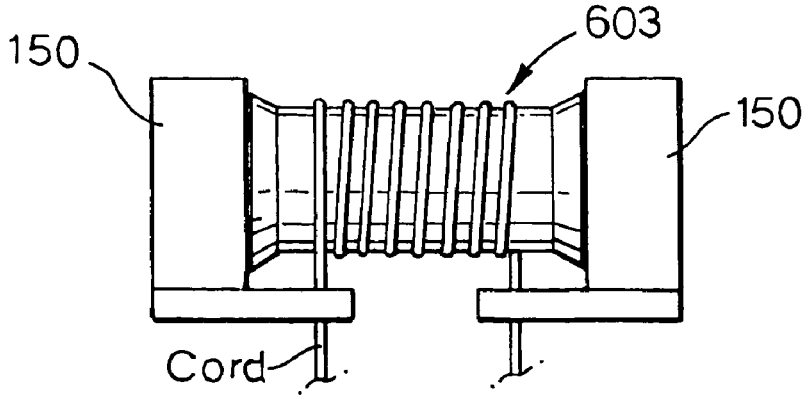
Figure 9:
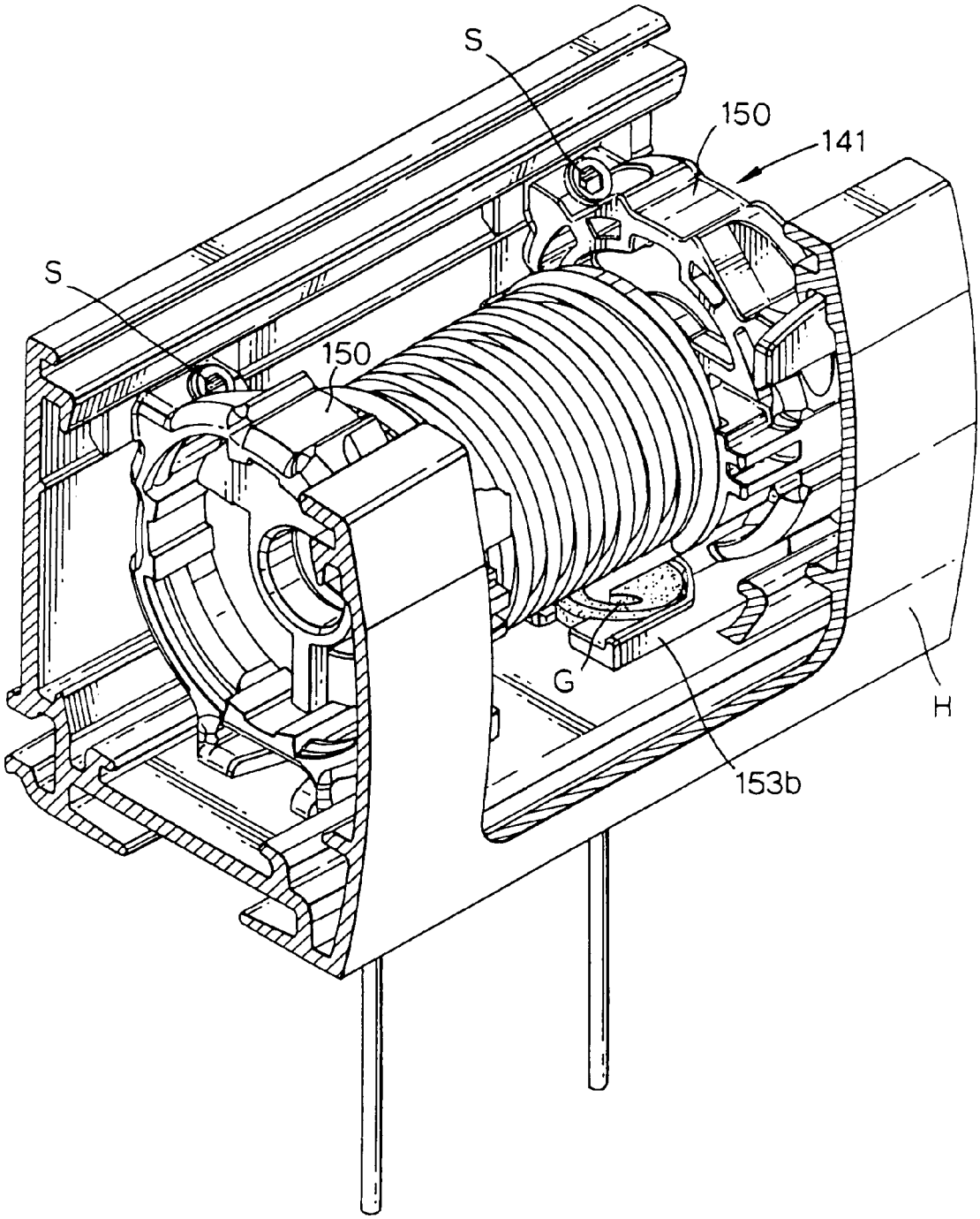

FIGS. 8*a*, 8*b* and 9 illustrate the assembled components for use in a head rail arrangement of the type described in GB 2,333,314. It will be seen that two identical support members 150 may be used at either end of spool 603. Because of the symmetric design of the support members 150, for instance with the cord cam 173 extending in both directions, it is possible for identical support members 150 to be used at either end. This has significant advantages in cost of manufacture. Indeed, furthermore, the same support member 150 may be used for arrangements such as illustrated in FIG. 1 where a cord is wound onto a spool and arrangements such as illustrated in FIG. 9 where a cord is coiled around the spool and simultaneously wound onto and wound off the spool. Hence, in addition, the advantages of providing a separate wear resistant grommet which connects the support member 150 to a head rail H are also available for the arrangement of FIG. 9 and architectural coverings as considered by GB 2,333,314.

In the preferred embodiment, the free side 141 of the support member 150 is provided with some means of attachment for attaching a further component axially in line with the support member 150 and the spool 3, 103, 203, 303, 403, 503 and 603. In a preferred embodiment, the attaching means comprise one or more resilient members and/or recesses which allow a further component to be snap-fitted to the free side 141 of the support member 150.

Figure 10:
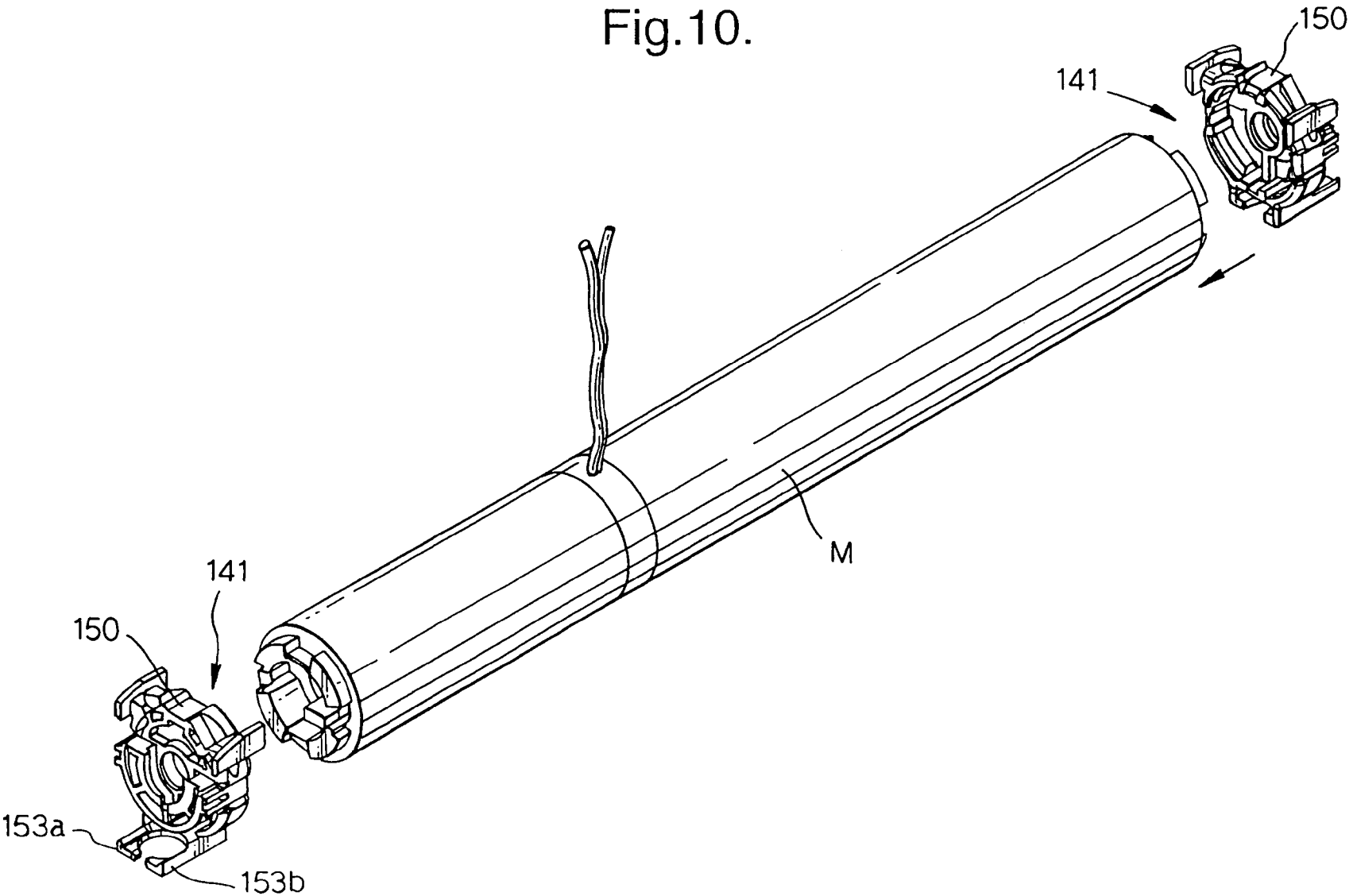
FIGS. 10 and 11 illustrate support members of the invention together with a drive mechanism.
Figure 11:
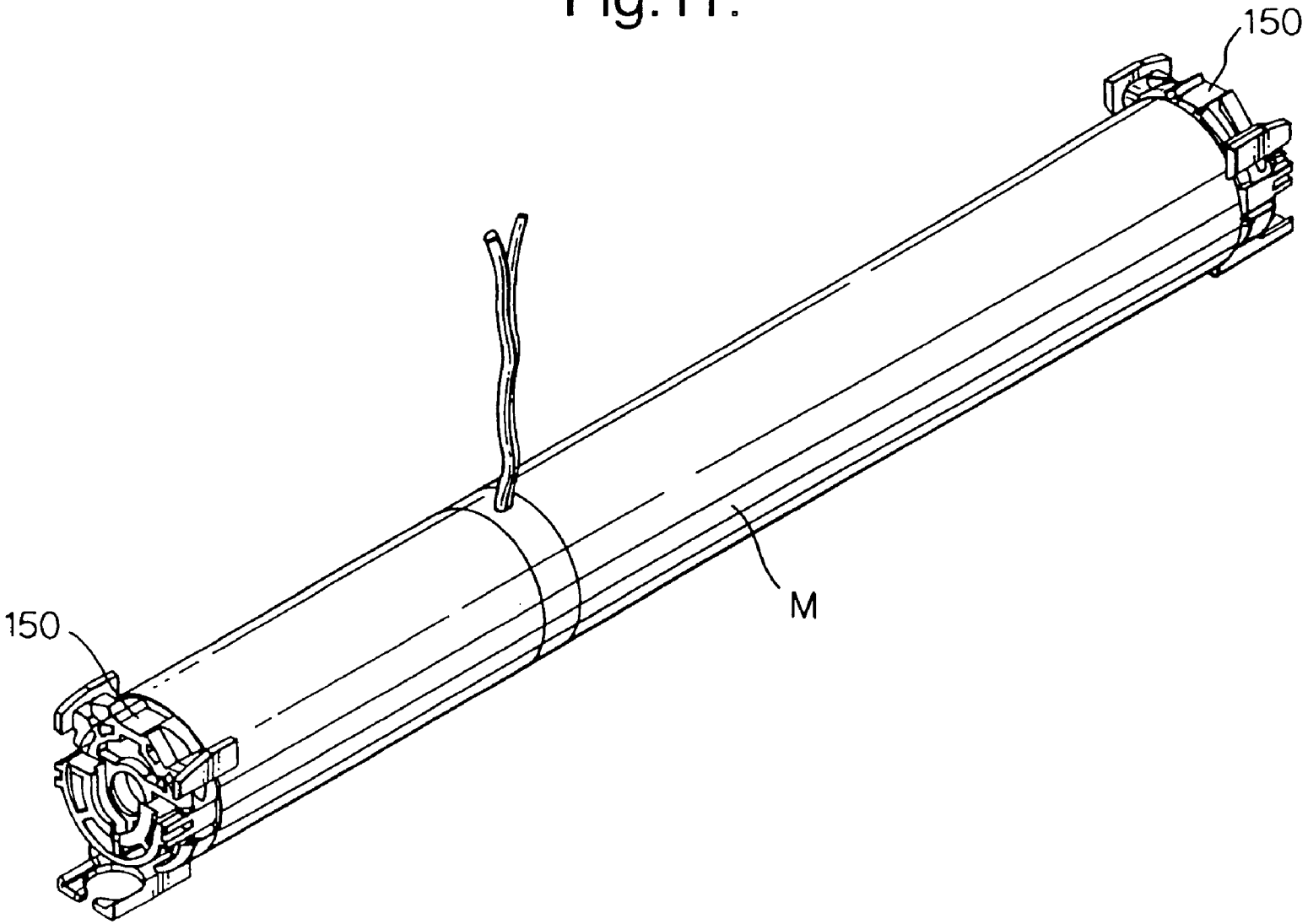

Thus, as illustrated in FIGS. 10 and 11, a motor M can be snap-fitted to the free side 141 of a support member 150 by means of appropriate features on the motor housing. In this way, support member 150 can provide an additional function of locating the motor in a head rail.

The drive shaft 11 merely extends through the central opening 151 of the support member 150 into the thus located motor M.

As illustrated, the motor housing can have a support member attached to it at either end. Where the motor provides an output drive at only one end, the support member 150 at the other end can be provided merely to support the motor housing in the head rail. However, in a preferred embodiment, the motor M provides drive at both of its ends. In this arrangement, at each end of the motor housing, a support member 150 could support a cord spool as described with reference to FIGS. 1 to 5. Alternatively, two additional support member 150 may be provided such that the motor drives two spools in the arrangement described with reference to FIGS. 7 to 9 and GB 2,333,314.

This invention is, of course, not limited to the above-described embodiments which may be modified without departing from the scope of the invention or sacrificing all of its advantages. In this regard, the terms in the foregoing description and the following claims, such as "longitudinal", "lateral", "inner", "outer", "right", "left", "top", "bottom", "downward", "front", "rear", "upper" and "lower", have been used only as relative terms to describe the relationships of the various elements of the control system of the invention for coverings for architectural openings. For example, kinematic inversions of the elements of the control systems, described above, are to be considered within the scope of the invention.

We claim:

1. A lifting and lowering mechanism for a blind, including: a rotatable drive shaft; at least one lift cord; and a cord spool for winding and unwinding the at least one lift cord and mounted for rotation with the drive shaft, the cord spool having a large diameter end and a small diameter end, defining a generally conical circumferential winding surface therebetween for the cord, said lift cord being wound onto and unwound from said large diameter end; wherein the cord spool has a plurality of longitudinally extending, radial ribs on the winding surface, which are located at least on the circumferential area adjoining the large diameter end.

2. The lifting and lowering mechanism of claim 1 wherein, the ribs extend along the entire length of the winding surface from the large diameter end to the small diameter end.

3. The lifting and lowering mechanism of claim 1 wherein the ribs are short ribs which extend only along a first longitudinal section of the spool and, the first longitudinal section starting at the large diameter end and extending a part of the entire length of the spool towards the small diameter end.

4. The lifting and lowering mechanism of claim 1 wherein a first spool section starts at the large diameter end and extends a part of the entire given length of the spool towards the small diameter end, a second spool portion extends towards the small diameter end after the first spool section, and the first spool section is conical with a stronger taper than the second spool section.

5. The lifting and lowering mechanism of claim 4 wherein, the length of the second spool section is longer than the length of the first spool portion.

6. The lifting and lowering mechanism of claim 1 wherein the large diameter end includes a mounting means and a support means with the mounting means rotatably mounting the cord spool in the support means, and wherein the support means includes a camming surface adjacent the large diameter end for moving a first winding of the cord about the spool in a direction away from the large diameter end of the cord spool, such that a next winding will not overlap the first winding.

7. The lifting and lowering mechanism of claim 1 further including at least one longitudinally extending slot in the small diameter end adapted to receive an end of the lift cord for attachment to the spool.

8. The lifting and lowering mechanism of claim 1, further including an end plug attached to the small diameter end to receive one end of the at least one lift cord.

9. The lifting and lowering mechanism of claim 8, wherein the end plug has a cylindrical portion forming an extension to the spool, but being without a taper or with a taper opposite to the spool.

10. The lifting and lowering mechanism of claim 8, wherein the end plug has a plurality of circumferentially distributed radial slots, each of which is adapted to receive an end of the at least one lift cord for attachment.

11. The lifting and lowering mechanism of claim 1, further including a support for rotatably supporting the cord spool.

12. The lifting and lowering mechanism of claim 11, wherein the support has a camming surface adjacent the large diameter end of the cord spool for guiding the lift cord to be wound onto the spool.

13. The lifting and lowering mechanism of claim 11 wherein a first side of the support is arranged to rotatably support the cord spool and a second side, opposite the first side, of the support is arranged to support a drive mechanism, such as a motor.

14. The lifting and lowering mechanism of claim 7 further including a grommet for insertion into a corresponding aperture in a head rail and for guiding said at least one lift cord to or from the cord spool, the support having a base arranged to hold the grommet, such that the support can be fixed to a head rail by means of the grommet.

15. The lifting and lowering mechanism of claim 12 further including a grommet for insertion into a corresponding aperture in a head rail and for guiding said at least one lift cord to or from the cord spool, the support having a base arranged to hold the grommet, such that the support can be fixed to a head rail by means of the grommet.

16. A lifting and lowering mechanism for a blind, including:

a rotatable drive shaft;

at least one lift cord; and a cord spool for winding the at least one lift cord and mounted for rotation with the winding shaft, the cord spool having a large diameter end and a small diameter end, defining a generally conical, circumferential winding surface therebetween for the cord;

wherein the cord spool has a plurality of longitudinally extending, radial ribs on the winding surface, which are located at least on the circumferential area adjoining the large diameter end, wherein a first number of long ribs extend along the entire length of the winding surface of the spool, and a second number of short ribs extend along a first longitudinal section of the spool and are shorter than the long ribs, the first longitudinal spool section starting at the large diameter end and extending a part of the entire length of the spool toward the small diameter end.

17. The lifting and lowering mechanism of claim 16, wherein, the first spool section the long and short ribs alternate about the circumference of the spool.

18. The lifting and lowering mechanism of claim 16 wherein the short ribs extending only along the first spool section and have a stronger taper than the long ribs extending along the entire length of the spool.

19. A lifting and lowering mechanism for a blind, including:

a rotatable drive shaft;

at least one lift cord; and a cord spool including an elongated, generally cylindrical body with a first end and a second end and a circumferential outer surface of a given length extending therebetween wherein the circumferential outer surface has a plurality of generally parallel extending longitudinal ribs, a first number of long ribs extending along the entire given length of the outer surface of the spool and a second number of short ribs extending along a first longitudinal section of the spool and are shorter than the long ribs with the first longitudinal spool section starting at the first end and extending a part of the entire given length of the spool toward the second end.

20. The lifting and lowering mechanism of claim 19 wherein in the first spool section the long and short ribs alternate about the circumference of the spool.

21. The lifting and lowering mechanism of claim 19 wherein the short ribs extend only along the first spool section and have a stronger taper than the long ribs which extend along the entire given length of the spool.

22. A lifting and lowering mechanism for a blind, including: a rotatable drive shaft; at least one lift cord; and a cord spool for winding and unwinding the at least one lift cord and mounted for rotation with the drive shaft, the cord spool having a large diameter end and a small diameter end, defining a generally conical circumferential winding surface therebetween for the cord, said lift cord being wound onto and unwound from said large diameter end; and wherein the ribs are tapered, being wider at the large diameter end and progressively narrowing in the direction of the small diameter end, wherein the cord spool has a plurality of longitudinally extending, radial ribs on the winding surface, which are located at least on the circumferential area adjoining the large diameter end.

23. A lifting and lowering mechanism for a blind, including:

a rotatable drive shaft;

at least one lift cord; and a cord spool including an elongated generally cylindrical body with a first end and a second end and a circumferential outer surface of a given length extending therebetween, said lift cord being windable onto said first end and unwindable from said first end, wherein the circumferential outer surface has a plurality of generally parallel extending longitudinal ribs, which are tapered being wider at the first end and progressively narrowing in the direction of the second end.

24. A lifting and lowering mechanism for a blind, including:

a rotatable drive shaft;

at least one lift cord; and a cord spool including an elongated generally cylindrical body with a first end and a second end and a circumferential outer surface of a given length extending therebetween, said lift cord being windable onto said first end and unwindable from said first end, wherein the circumferential outer surface has a plurality of generally parallel extending longitudinal ribs.

25. The lifting and lowering mechanism of claim 24 wherein the ribs extend along the entire given length of the outer surface from the large diameter end to the small diameter end.

26. The lifting and lowering mechanism of claim 24 wherein the ribs are short ribs which extend only along a first longitudinal section of the spool and, the first longitudinal section starting at the first end and extending a part of the entire given length of the spool towards the second end.

27. The lifting and lowering mechanism of claim 24 wherein the first end includes a mounting means for rotatably mounting the cord spool in a support means, and wherein the support means includes a camming surface adjacent the first end for moving a first winding of the cord about the spool in a direction away from the first end of the cord spool, such that a next winding will not overlap the first winding.

28. The lifting and lowering mechanism of claim 24 further including at least one longitudinally extending slot in the second end adapted to receive an end of the lift cord for attachment to the spool.

29. The lifting and lowering mechanism of claim 24 further including an end plug attachable to the second end and adapted to receive an end of the lift cord for attachment to the spool.

30. The lifting and lowering mechanism of claim 29 wherein the end plug has a longitudinally extending cylindrical portion forming an extension to the cord spool.

31. The lifting and lowering mechanism of claim 29 wherein said second end and the end plug include respective cooperating features which are able to secure resiliently the elongated generally cylindrical body and the end plug in a plurality of relative angular positions such that the end plug may be snap indexed between the relative angular positions to adjust cord length.

32. The lifting and lowering mechanism of claim 29 wherein the end plug has a plurality of circumferentially distributed radial slots, each of which is adapted to receive an end of the at least one lift cord for attachment.

33. The lifting and lowering mechanism of claim 27 wherein a first side of the support is arranged to rotatably support the cord spool and a second side, opposite the first side, of the support is arranged to support a drive mechanism, such as a motor.

* * * * *